United States Patent [19]

Bradley

[11] Patent Number: 4,756,535

[45] Date of Patent: Jul. 12, 1988

[54] GOLF PUTTER

[76] Inventor: Michael R. Bradley, 126 Pine Rd.-Gulf Hills, Ocean Springs, Miss. 39564

[21] Appl. No.: 39,180

[22] Filed: Apr. 17, 1987

[51] Int. Cl.[4] ..... A63B 69/36; A63B 53/04

[52] U.S. Cl. ..... 273/183 D; 273/167 H; 273/164; 273/174; 273/171; 273/78

[58] Field of Search ..... 273/167 A, 174, 77 R, 273/171, 164, 167 H, 183 D, 191 R, 192, 78

[56] References Cited

U.S. PATENT DOCUMENTS

| | | | |
|---|---|---|---|
| 2,426,274 | 8/1947 | Kramer | 273/174 |
| 2,708,579 | 5/1955 | Hugman | 273/174 |
| 2,781,197 | 2/1957 | Wiley | 273/171 |
| 2,865,635 | 12/1958 | Jessen | 273/183 D |
| 3,044,781 | 7/1962 | Murphy | 273/193 |
| 3,199,873 | 8/1965 | Surratt | 273/183 D X |
| 3,220,730 | 11/1965 | Fine | 273/77 R |
| 3,680,868 | 8/1972 | Jacob | 273/164 |
| 3,758,115 | 9/1973 | Hoglund | 273/167 A |
| 4,535,992 | 8/1985 | Slagle | 273/194 A |

FOREIGN PATENT DOCUMENTS

| | | | |
|---|---|---|---|
| 11463 | 4/1903 | United Kingdom | 273/174 |

OTHER PUBLICATIONS

"P"ro-gressive Putting Technique with the incredible Deadly Duo, Fred Slagle, 1983.

*Primary Examiner*—George J. Marlo
*Attorney, Agent, or Firm*—Banner, Birch, McKie & Beckett

[57] ABSTRACT

There is disclosed a golf putter in which a relatively thin wheel-like member is mounted on a horizontal axis in a slot along the center of the club head, the wheel-like member extending below the bottom face of the club to provide a ground engaging point and being visible along the center of the club at the top face to provide a sighting line—the wheel-like member being adapted to be fixed for use in play or rotatable for use in training.

7 Claims, 2 Drawing Sheets

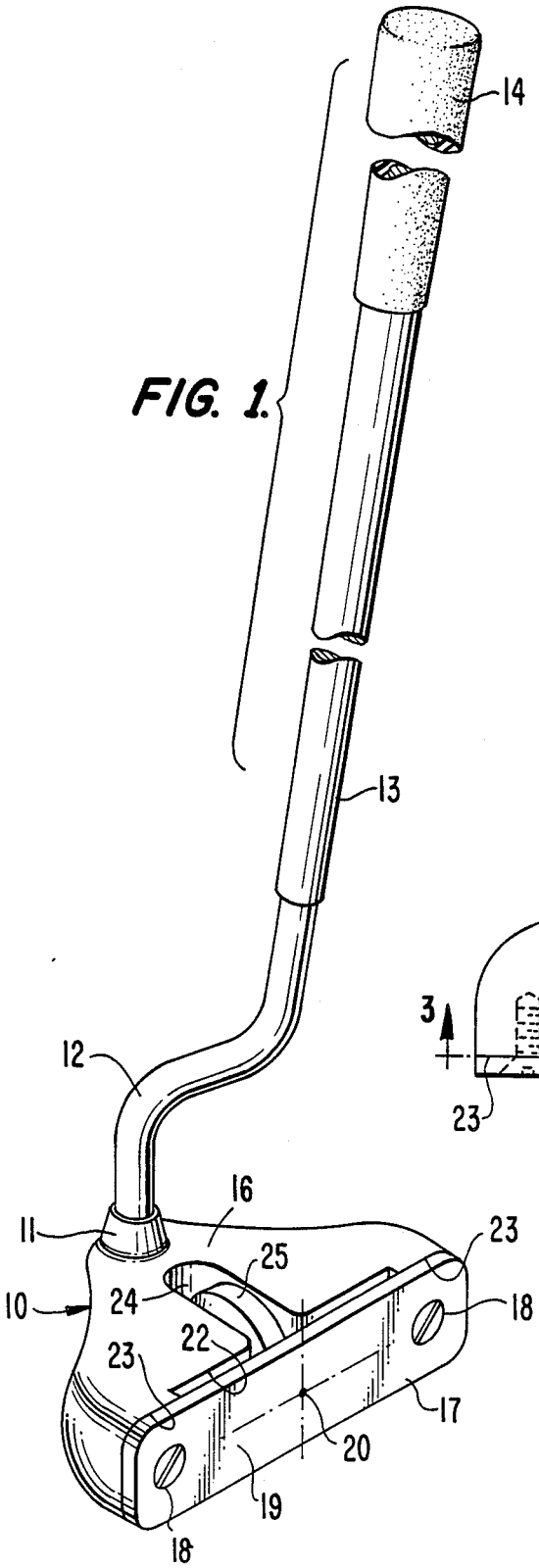
FIG. 1.
FIG. 2.
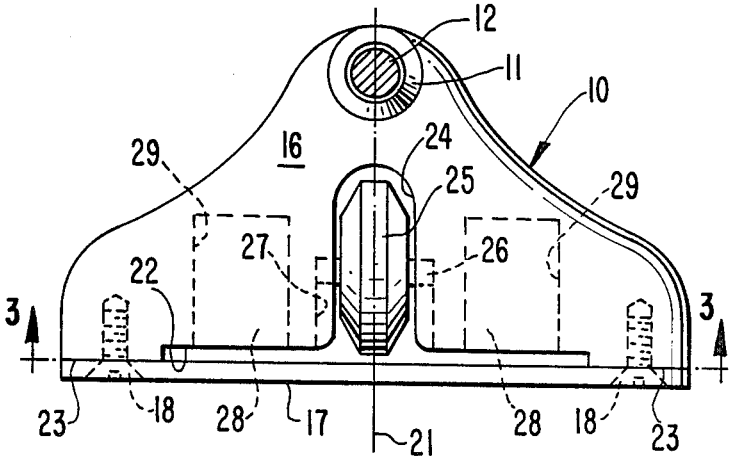

GOLF PUTTER

FIELD OF THE INVENTION

This invention relates to a golf club and more particularly to a golf putter having means for assisting in aligning the club during a putting stroke and for maintaining the alignment during the stroke.

BACKGROUND OF THE INVENTION

The prior art discloses various golf clubs having roller means on the ground-engaging face to facilitate movement of the club over the ground, such as U.S. Pat. Nos. 2,426,274, 3,044,781, 3,199,873 3,680,868 and 4,535,992. The advantages of a roller means are that it will tend to cause the club to move in a line defined by the direction of rotation of the roller and that it will maintain a minimum distance between the club head and the playing or putting surface and thus permit contact of the head with a hard surface such as frozen ground or, for indoor practicing for example, concrete or wood. Reducing the drag between the club and the ground also reduces the tendency for the club head to be deflected or to turn about the shaft and thus to be skewed when it strikes the ball as for example when the toe of the club brushes the ground, which tends to rotate the head about the shaft.

Because a golf putter sanctioned for tournament play cannot have movable parts, clubs with rollers have generally been designated for training or practice purposes and not for play. Training systems have also been offered in which there is used a set of two putters including a training putter having roller means and a playing putter from which the roller means is eliminated. ideally of course both the training clubs and the playing clubs should be the same or as nearly alike as possible.

There is also in the prior art various disclosures of golf clubs with markings on the head for aligning the head with the ball and for indicating the direction of the swing, such as U.S. Pat. Nos. 3,199,873 and 3,680,868 mentioned above as well as U.S. Pat. Nos. 2,781,197 and 2,865,635.

SUMMARY OF THE INVENTION

In accordance with this invention there has been provided a golf putter having a roller means projecting from its ground-engaging face, which putter can be adapted for use in playing with substantially the same appearance and feel and which, in both the training/-practice version and the playing version, includes virtually identical means that is particularly effective for aligning the club with the ball and the hole. This is achieved by a relatively narrow wheel-like member that is disposed in a slot that extends vertically through the head along the center line thereof with the bottom of the wheel extending below the bottom face of the head and the top of the wheel visible at the top face.

For training purposes, the wheel is journaled for rotation to facilitate movement of the putter over the putting surface as well as to help guide it and to avoid angular deflection of the club head about the shaft if the toe of the club for example contacts the ground. For playing purposes the wheel is fixed which for purposes of appearance and feel results in a club that is virtually identical to the training or practice club. With respect to performance, the bottom portion of the wheel in the playing club serves as a skid which closely approximates the function of the rotating wheel in the training version.

In both versions the top portion of the wheel is visible on the top face of the club. Being aligned along the center of the head through the "sweet spot" on the ball-engaging face, the wheel serves as an effective indicia for aligning the club with the ball and with the hole.

BRIEF DESCRIPTION OF THE DRAWINGS

FIG. 1 is a perspective view of a golf club in accordance with the present invention.

FIG. 2 is a horizontal sectional view of the golf club of FIG. 1 immediately above the top face thereof.

DETAILED DESCRIPTION OF THE PREFERRED EMBODIMENT

Figure 3:
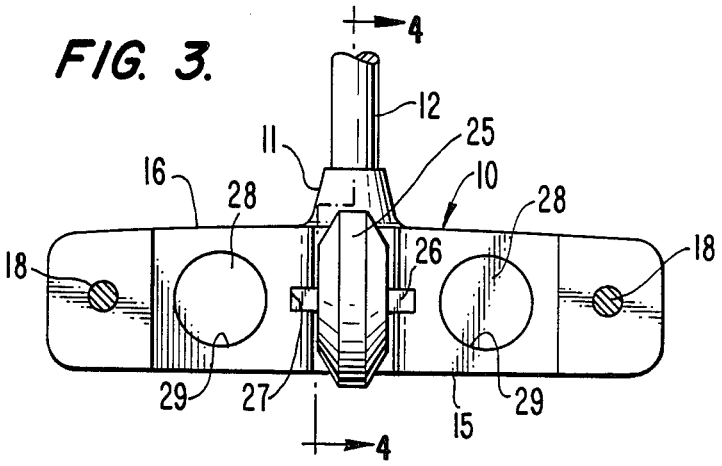
FIG. 3 is a sectional view taken substantially on the line 3—3 of FIG. 2.

With reference to the drawings there is shown a golf putter comprising a head 10 having a socket 11 at the rear edge of the upper face thereof. The socket 11 receives the bottom portion of the hosel 12 which at its upper end is received within the bottom of the shaft 13 that is in turn provided with a handgrip 14 at its upper end.

The head 10 has a bottom face 15 that is substantially flat or planar and is adapted to be substantially parallel to the putting surface during a putting stroke. The top face 16 of the head 10 is also substantially flat and is spaced from and substantially parallel to the bottom face 15.

At the front of the head 10 there is provided a plate 17 secured to the head by a pair of screws 18 threaded into the head. The plate 17 has a front face 19 that comprises the ball-engaging face of the putter and includes the so-called sweet spot 20 at the center of the horizontal and vertical axes thereof (FIG. 1)-the sweet spot being the center of the face 19 relative to the center of gravity of the head so that when the head of the club engages a ball on the sweet spot, the mass of the club is delivered directly though the center of gravity of the ball.

The head 10 is substantially symmetrical relative to the longitudinal centerline 21 (FIG. 2) thereof which is defined by a vertical plane through the axis of the socket 11 and through the sweet spot 20 which balances the head 10 relative to the shaft 13.

The head 10 is provided with a recess 22 in the front face thereof that provides lands 23 against which the front plate 17 is seated and through which the screws 18 are threaded. There is also provided in the head 10 a vertical slot 24 extending from the front face thereof along the center line 21. Slot 24 is open at both the top face 16 and the bottom face 15 of the head and extends inwardly for over one-half of the longitudinal dimension of the head.

The slot 24 is wide enough to receive a relatively narrow wheel or wheel-like member 25 that is mounted on an axle 26 seated at its ends in grooves 27 which extend inwardly from the front face of head 10 along each side of the slot 24. The grooves 27 are substantially parallel to the bottom face 15 of the head and spaced substantially equidistantly from the top face 16 and the bottom face 15, that is, the grooves are located to position the axle 26 directly behind the sweet spot 20 of the ball-engaging face 19.

As shown in the drawings, the wheel-like member 25 is circular and has a diameter dimensioned to position the sweet spot 20 substantially at the level of the center of gravity of the ball when the bottom of the wheel touches the putting surface. The head is also dimensioned relative to the diameter of the wheel-like member 25 so that the bottom portion of the member 25 extends a short distance from the bottom face 15 of the head and the top portion thereof is clearly visible on the top face 16 of the head.

Figure 4:
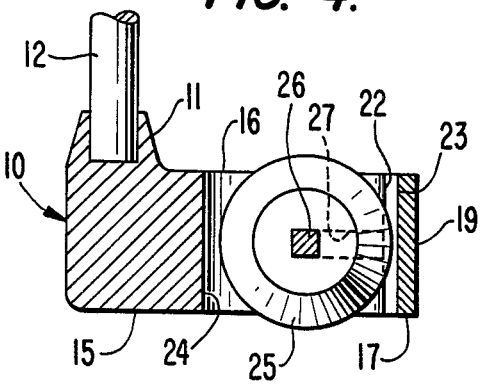
FIG. 4 is a sectional view taken substantially on the line 4—4 of FIG. 3.

The axle 26 as shown in FIG. 4 is square in cross section whereby the wheel 25 is locked and the bottom portion thereof that extends below the bottom face 15 of the head 10 provides in effect a skid that will engage the ground and thus permit the club to travel more easily relative to the ground when the bottom face 15 contacts the ground during a putting stroke. It also spaces the bottom face 15 of the head from the ground so that, in the event the bottom face 15 is not parallel to the ground during a putting stroke and the club is swung into contact with the ground, contact will be on the bottom or skid portion of the wheel-like member 25. This tends to keep the toe of the head for example from engaging the ground, and thus avoids the pivoting of the head 10 about the shaft 13 that would occur if the toe did contact the ground—which in turn would cause the front face 19 to be thrown out of alignment relative to the ball so that it is no longer square with the ball in the direction of the putting stroke.

Figure 5:
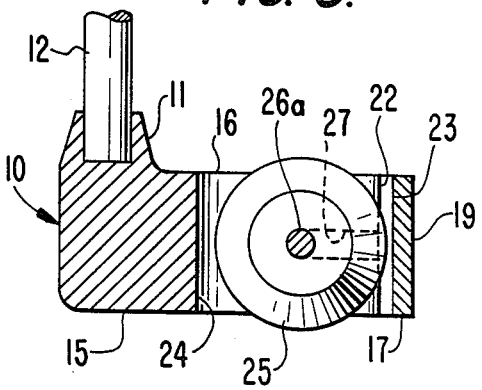
FIG. 5 is a view similar to FIG. 4 but showing the training version of the club.

The club shown in FIG. 4 is adapted for use in playing where the rules require that the club may not include any moving parts. The club may also be adapted for use in training or practice by using a round axle **26*a* as shown in FIG. 5 in lieu of the square axle 26. With the wheel-like member 25 journaled for rotation on the axle 26a, resistance to movement of the head 10 over the ground is further reduced relative to that of the head as shown in FIG. 4 as the member 25 rotates rather than slides over the ground when the bottom face 15 of the head 10** contacts the ground during a putting stroke.

Figure 6:
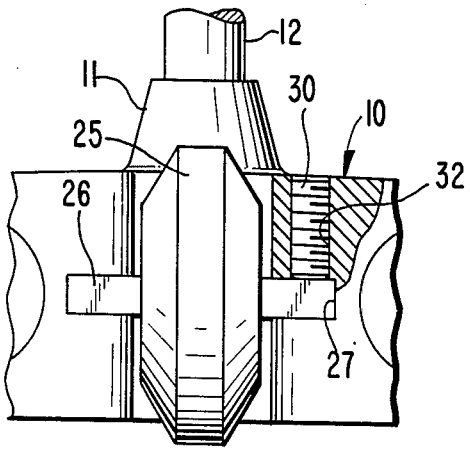
FIG. 6 is a fragmentary sectional view illustrating a modification of the invention.

As shown in FIGS. 4 and 5, the axles 26 and **26*a* are adapted to be press-fit in the grooves 27, which is a relatively permanent assembly and thus would normally require that a player have two separate putters—one with the fixed wheel for playing and one with the rotary wheels for practice. A single convertible club is also possible as shown in FIG. 6 in which there is shown a club having a wheel fixed on the round axle 26*a* that is adapted to rotate in the grooves 27 and a set screw 30 threaded through the head to lock the axle 26*a* against rotation. Similarly, the axle 26*a* could be press-fit in the grooves 27** and the wheel rotatable on the axle with a set screw in the wheel for locking it to the axle.

Figure 7:
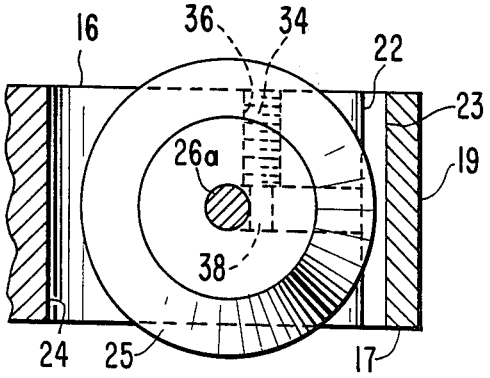
FIG. 7 is a fragmentary sectional view illustrating another version of the invention.

In FIG. 7 there is shown a head 10 with a replaceable wheel 25 on an axle **26*a* that is adapted to be inserted loosely into the grooves 27 and retained therein for example by a pin 38 on the end of a set screw 34 threaded into a bore 36 in the head 10. The wheel 25 is shown as fixed on a round axle 26*a* and thus is adapted to rotate. By substituting a wheel with a square axle, the wheel will be locked against rotation relative to the axle, which is in turn locked against rotation in the grooves 27**.

With a wheel-like member 25 that is relatively narrow or disk-like and that extends to the top face 16 of the head 10, the top portion of the member 25 provides a sighting line for aligning the club with the ball and for indicating the direction of movement for the head during the putting stroke—the effect being enhanced for example by profiling the periphery of the wheel-like member 25 to provide a raised portion at the center that will provide a line-like sighting line as well as line-like contact with the putting surface. The psychological effect of a rolling wheel tends to compel the golfer to stroke the club to the direction in which the wheel is designed to move over the ground, thus automatically aligning the face of the head squarely with the ball and with the direction in which the club head is to be moved. The wheel-like member 25 also serves to position the club head vertically relative to the ball to provide the optimum contact between the head and the ball.

The transitiion from the club with a rotating wheel-like member 25 that's used in training and practice and the one with the locked wheel that is used in playing is relatively simple since the appearance and feel of the two clubs is identical. The periphery of the wheel-like member 25 is visible at the top face 16 of the head and provides a sighting line and the bottom portion of the wheel-like member 25 acts to space the head relative to the ground and to reduce resistance to movement of the head over the ground. The weight and the balance of the club is identical to that of the training club, both of which can be personalized by a pair of weights 28 that may be received in bores 29 in the head 10.

Modifications of the present invention will be obvious to those skilled in the art.

Having thus described the invention, what is claimed is:

1. A golf club comprising a shaft having a hand grip at the upper portion thereof and a putting head secured to the bottom end thereof, said head having a substantially planar bottom face adapted to be disposed substantially parallel to the putting surface during a putting stroke, a top face disposed in spaced relation to said bottom face, a front face substantically normal to said bottom face and substantially normal and centered relative to the centerline of said head at the front edge thereof, said front face having a sweet spot at the intersection of the horizontal and vertical axes thereof defining an optimum ball-engaging point on said front face, an elongated slot in said head open at said top face and said bottom face, said slot being substantially normal to said bottom face and to said front face and centered relative to the center of said head, a relatively thin wheel-like member having a width that is substantially less than its diameter mounted in said slot on an axis substantially parallel to said bottom face and to said front face and behind the sweet spot whereby said wheel-like member is arranged substantially normal to said bottom face, said wheel-like member being dimensioned whereby the bottom portion thereof extends from said bottom face to provide a ground-engaging surface and the upper portion thereof is visible at said top face, the upper edge of said wheel-like member being aligned substantially on the centerline of the head through the sweet spot and serving to indicate the direction of movement of the head during a putting stroke.

2. A golf club in accordance with claim 1 in which said wheel-like member is journaled for rotation in said head.

3. A golf club in accordance with claim 1 in which said wheel-like member is secured in said head against rotation.

4. A golf club in accordance with claim 1 in which said wheel-like member is adapted to be both journaled for rotation in said head and to be secured in said head against rotation.

5. A golf club in accordance with claim 4 in which said putting head is secured to said shaft at a point adjacent to the rear edge of and on the centerline of the head.

6. A golf club in accordance with claim 1 in which said top face is substantially planar and generally parallel to said bottom face.

7. A golf club in accordance with claim 1 in which said front face comprises a plate secured to said head and closing the open end of said slot.

* * * * *